US007252289B2

(12) United States Patent
Tamian

(10) Patent No.: US 7,252,289 B2
(45) Date of Patent: Aug. 7, 2007

(54) DRAGON-NAME GAME

(75) Inventor: Richard Tamian, 69 Edison Ter., Sparta, NJ (US) 07871

(73) Assignee: Richard Tamian, Sparta, NJ (US)

( * ) Notice: Subject to any disclaimer, the term of this patent is extended or adjusted under 35 U.S.C. 154(b) by 155 days.

(21) Appl. No.: 11/168,731

(22) Filed: Jun. 28, 2005

(65) Prior Publication Data

US 2006/0290054 A1 Dec. 28, 2006

(51) Int. Cl.
*A63F 9/04* (2006.01)

(52) U.S. Cl. ..... 273/146; 273/272

(58) Field of Classification Search ..... 273/146, 273/272, 299, 268

See application file for complete search history.

(56) References Cited

U.S. PATENT DOCUMENTS 3,195,895 A * 7/1965 Kropinski ..... 273/240
4,521,197 A * 6/1985 Lumpkins ..... 434/110
7,018,210 B2 * 3/2006 Goldman et al. ..... 434/172

OTHER PUBLICATIONS http://boardgamegeek.com/game/1860, website describing Dragon Dice, 1995.*

* cited by examiner

*Primary Examiner*—William M. Pierce

(57) ABSTRACT

The Dragon-Name Game is a unique letter, word, and number dice game consisting of; a special six-sided, six-colored die having the letters D.R.A.G.O.N. individually placed, one letter and color per each face side, see FIG. 2; a partitioned six-sided blank-surfaced die used for the inscription of the letters of a player's name, see FIG. 3; and a score card to record the numerical points, see FIG. 1; and played with a standard six-sided dotted casino die. The Dragon-Name Game is a competitive dice game designed particularly for children of grammar school age, whereby, the object of said game is to match the letters from the D.R.A.G.O.N. die to respective letters on the score card, while accruing numerical points from the casino die. By substituting the blank-sided die, other selected words and names can also be used as reference words. The player with the highest score after four rounds of play, wins. The Dragon-Name Game is an educational device for developing and improving letter, word, and number recognition with letter catenation for spelling the reference word, and numerical addition.

5 Claims, 5 Drawing Sheets

DRAGON-NAME GAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTENING, A TABLE, OR A COMPUTER PROGRAM LISTENING COMPACT DISC APPENDIX

Not Applicable

BACKGROUND OF INVENTION

The present invention relates generally to an educational device for developing and improving letter, word, and number recognition using the processes of letter catenation and numerical addition. More particularly, the present invention relates to a game consisting of a special six-sided, six-colored D.R.A.G.O.N. lettered die, a six-sided partitioned blank surfaced die for inscribing letters of selected words and names, and a score card for recording numerical points. Letter tile games such as, U.S. Pat. No. 5,567,159 issued to Tehan (1996); U.S. Pat. No. 5,554,062 issued to Goldsen (1996); U.S. Pat. No. 4,690,410 issued to Berton (1987) and others are of the "Scabble" (Registered Trademark) type, which are played by forming words that criss-cross in a crossword puzzle pattern, while the "Boggle" (Trademark) type of games, such as U.S. Pat. No. 4,474,371 issued to Silbermintz (1984); U.S. Pat. No. 5,080,370 issued to Lu (1992) and U.S. Pat. No. 6,685,477 issued to Goldman et al. (2004) rely on creating words by visually recognizing the letter patterns from a random mix of letter cubes. Even though these games are fine in developing word comprehension and perception for the eleven year olds and up, they are far too complicated and advanced for the early grammar school players.

BRIEF SUMMARY OF THE INVENTION

The Dragon-Name Game is a unique, yet simple number, letter and word recognition game designed for the early grammar school learner and played with a conventional standard dotted casino die and a special die containing the letters of a reference word (e.g. D.R.A.G.O.N.), such that each said letter of said reference word is individually inscribed on a different colored surface of said die (see FIG. 2). During each turn, a player rolls both dice. As each letter is rolled on the D.R.A.G.O.N. die, the respective numerical points from the casino die are placed in a corresponding point value box (14) on the score card to the right of each of these letter. A round of play ends when any one player completely fills all the D.R.A.G.O.N. (14) boxes with numerical points in that column. The player with the highest number of points after four rounds of play, wins. Another variation of said game is to select a player's name (e.g. A.L.E.X.A.N.D.E.R.) as an alternative reference word by inscribing one of each letter per blank surface on the blank-sided die (see FIG. 3) by using an erasable black marker, and then substitute said die for the D.R.A.G.O.N. die. These letters (e.g. A.L.E.X.A.N.D.E.R.) must also be written-in on the score card in the letter boxes (15) (see FIG. 1.). The reference word on the die and score card must be the same.

Games such as U.S. Pat. No. 5,306,153 issued to Foster (1994) that form simple words and anagrams do not offer the flexibility of inputting a player's name, which is a word most familiar to that learner, or any other selected word into the function of the game to be used as the reference word like my invention does. The object of the present invention is to offer an entertaining and competitive way to teach young players how to recognize the letters of a reference word like D.R.A.G.O.N. and like A.L.E.X.A.N.D.E.R., and then how to spell these selected reference words by catenating the letters that comprise it. The six different colors associated with the letters on the D.R.A.G.O.N. die assist the younger players with letter and word apperception. Another object of the present invention is to teach the players how to quantitate the dots on the casino die into numerical number values. And for the more advanced, older students, how to sum these numerical point values into a final score.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
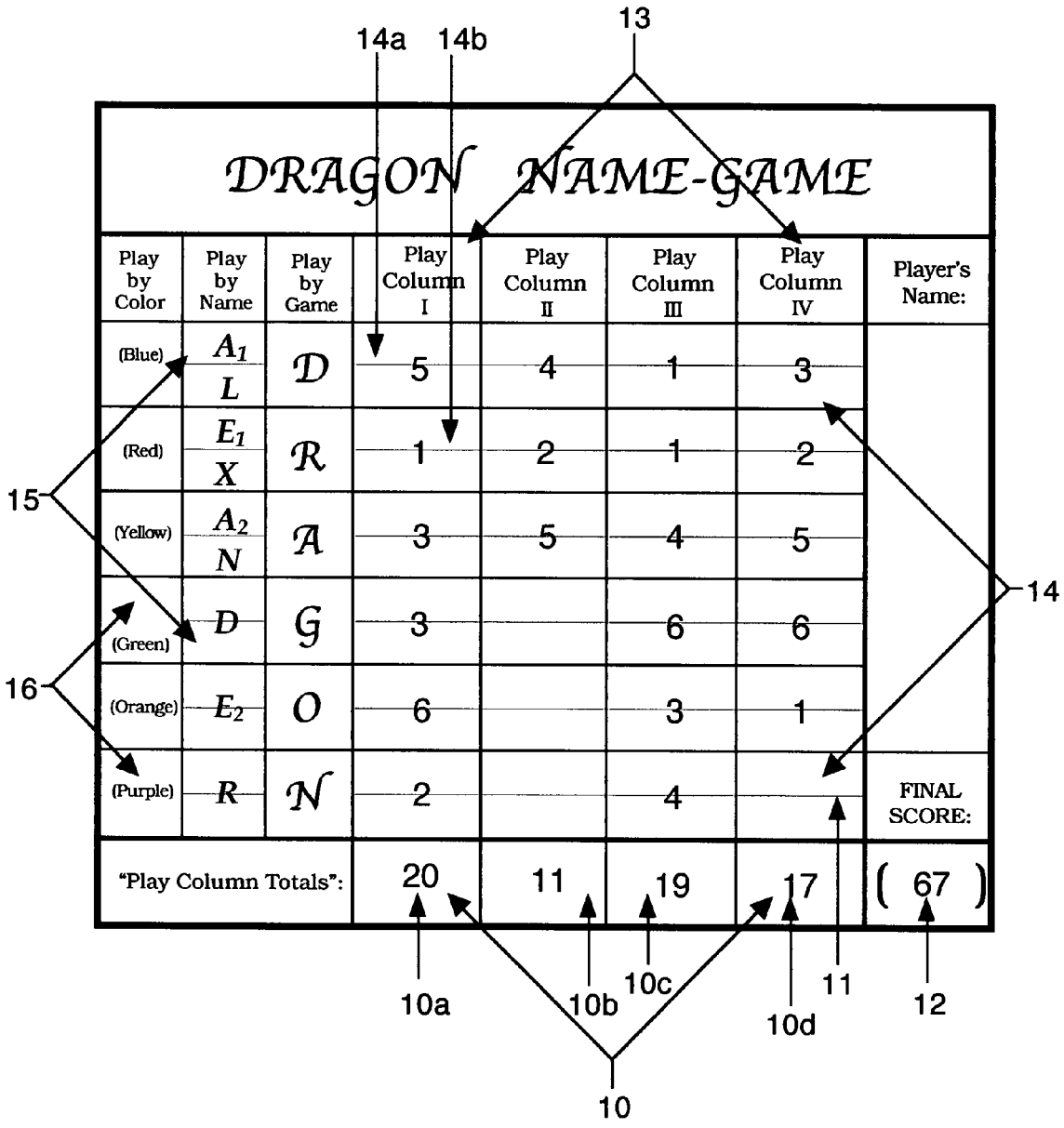
FIG. 1 is a plan view of the score card of this invention illustrating the (a) D.R.A.G.O.N. letters that are used as a reference word; (b) the subdivided letter boxes (15), used in conjunction with the blank lettered die, that are used for inputting the letters for an alternative reference word (e.g. A.L.E.X.A.N.D.E.R.); (c) the respective point value boxes (14), that are arranged in four columns (13), are used to store the numerical points from the casino die which determines the play column totals (10) that when summed yields the player's final score (12); and (d) the respective colors (16) associated with each of the letter surfaces of said D.R.A.G.O.N. die.
Figure 2:
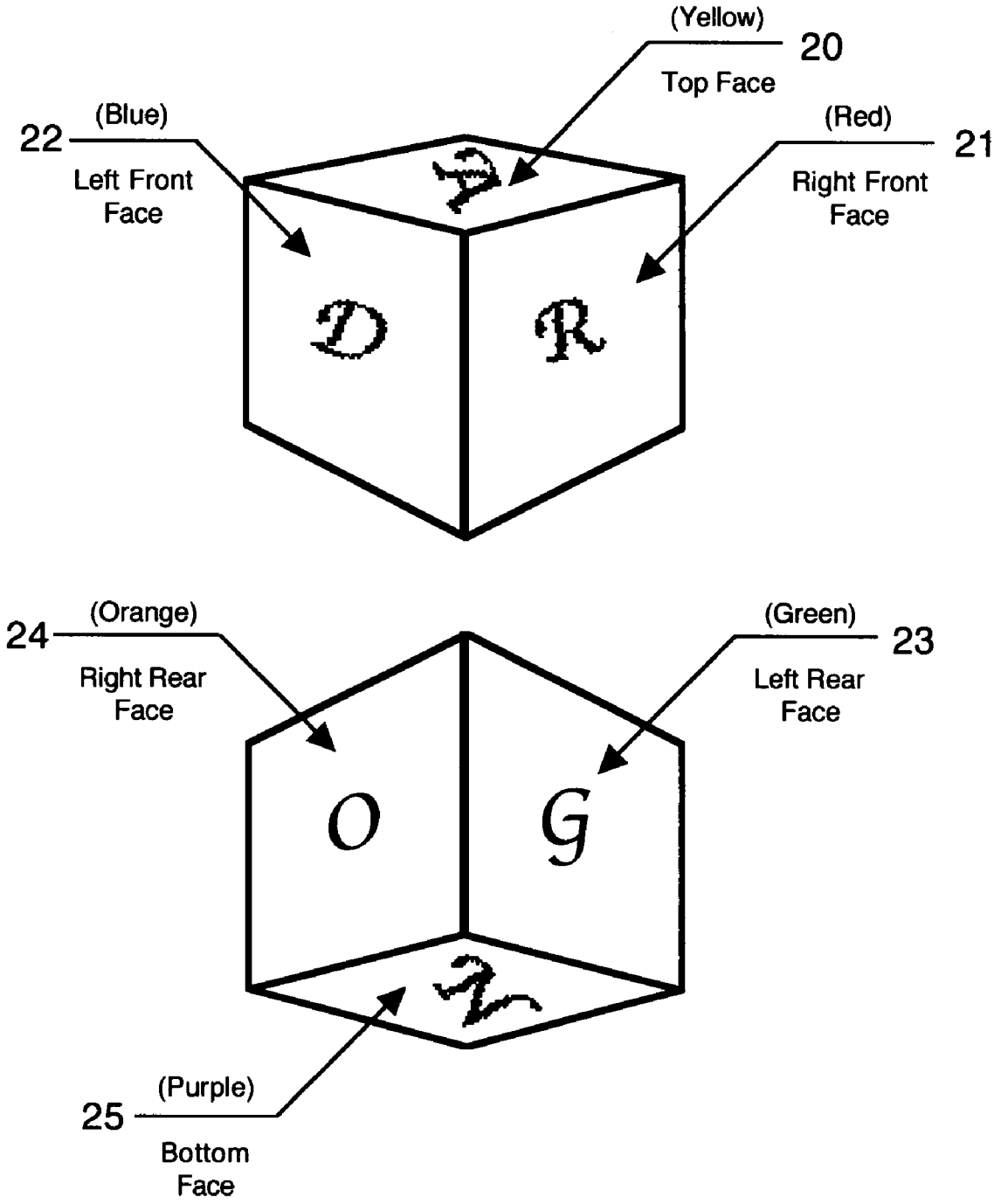
FIG. 2 is a view of the D.R.A.G.O.N. game die of this invention, wherein each said letter, D.R.A.G.O.N. is inscribed individually on a side of said die, and each said letter surface is associated with a color, such that the "D" is associated with the left front "blue" surface (22) of said die, the "R" is associated with the right front "red" colored surface (21), the "A" is associated with the top surface colored "yellow" (20), the "G" is associated with the left rear "green" colored surface (23), the "O" is associated with the right rear "orange" colored surface (24), and the "N" is associated with the bottom "purple" colored surface (25), as viewed in FIG. 2.
Figure 3:
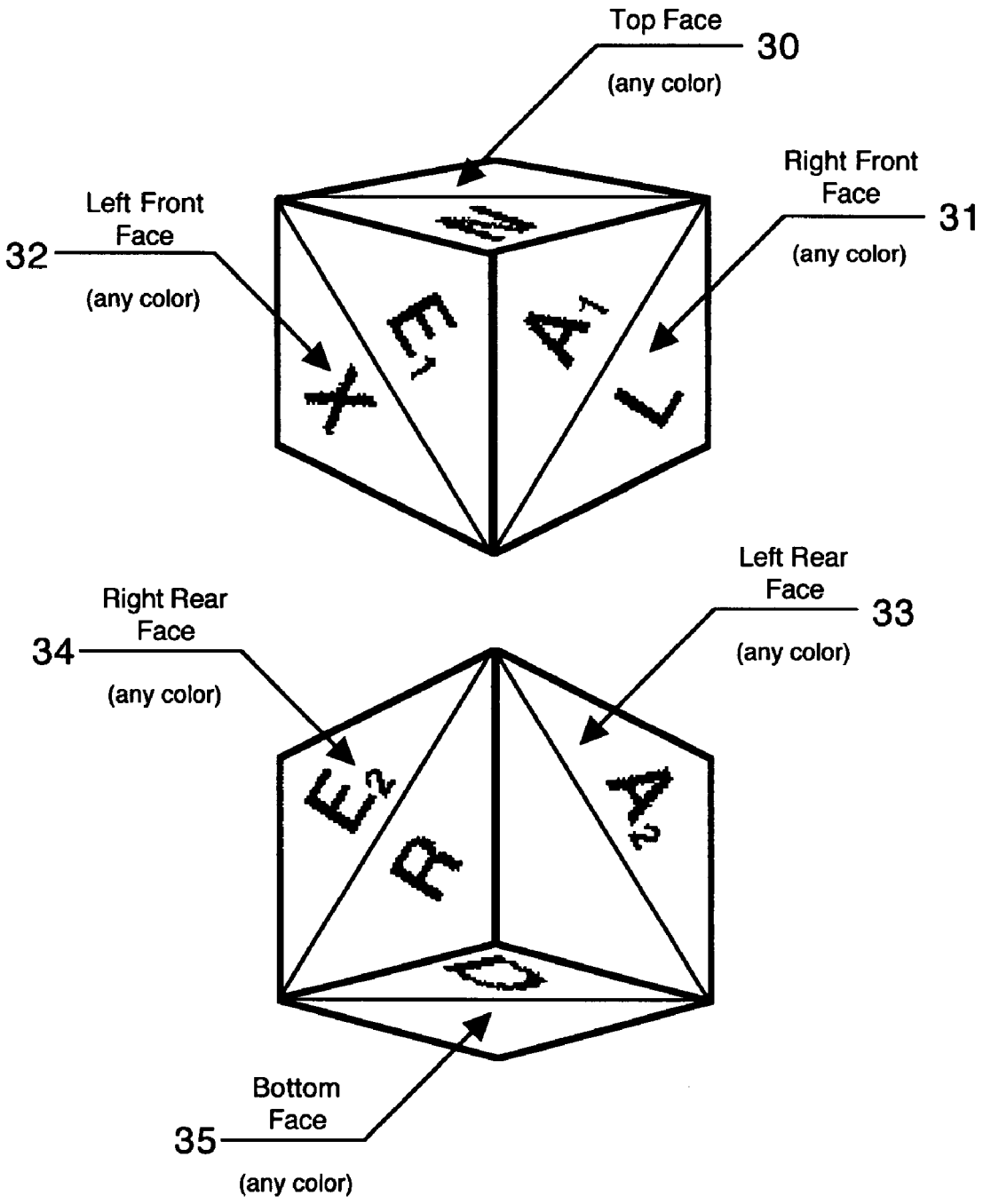
FIG. 3 is a view of the blank, six-sided die, used in conjunction with the letter (15) boxes on the score card of this invention, whose six surfaces are shown to be partitioned for inscribing the letters of an alternative reference word having more than six letters, such as a player's name (e.g. A.L.E.X.A.N.D.E.R.), which is substituted for the D.R.A.G.O.N. letter die when playing said game with more skilled players. Each surface face can accommodate more than one letter (e.g. A/L), such as in the right front face (31), left front face (32) (e.g. $E_1$/X), and right rear face (34) (e.g. $E_2$/R).
Figure 4:
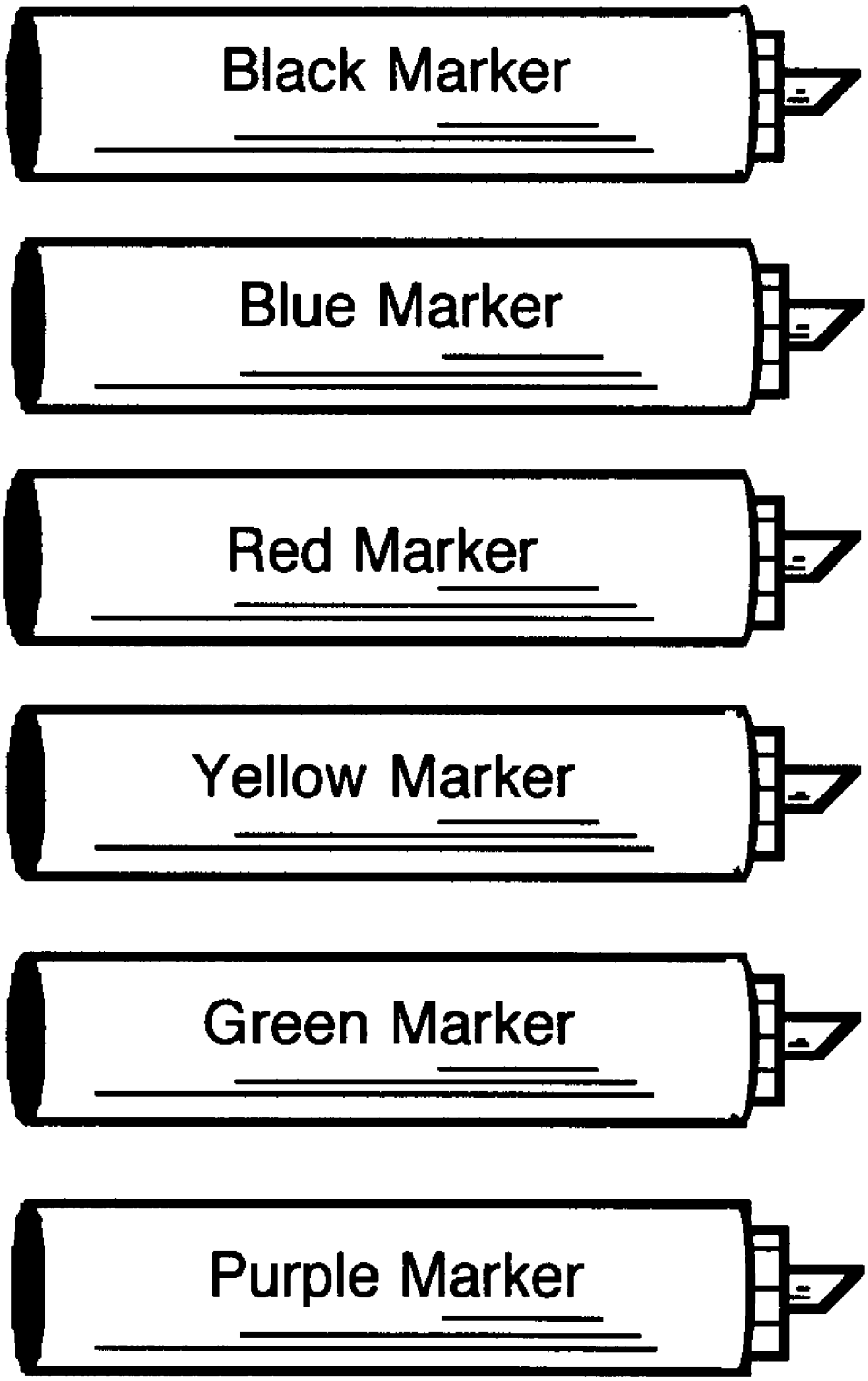
FIG. 4 is a view of the colored markers used to draw letters and colors of any choice on blank surfaces of the six-sided die.
Figure 5:
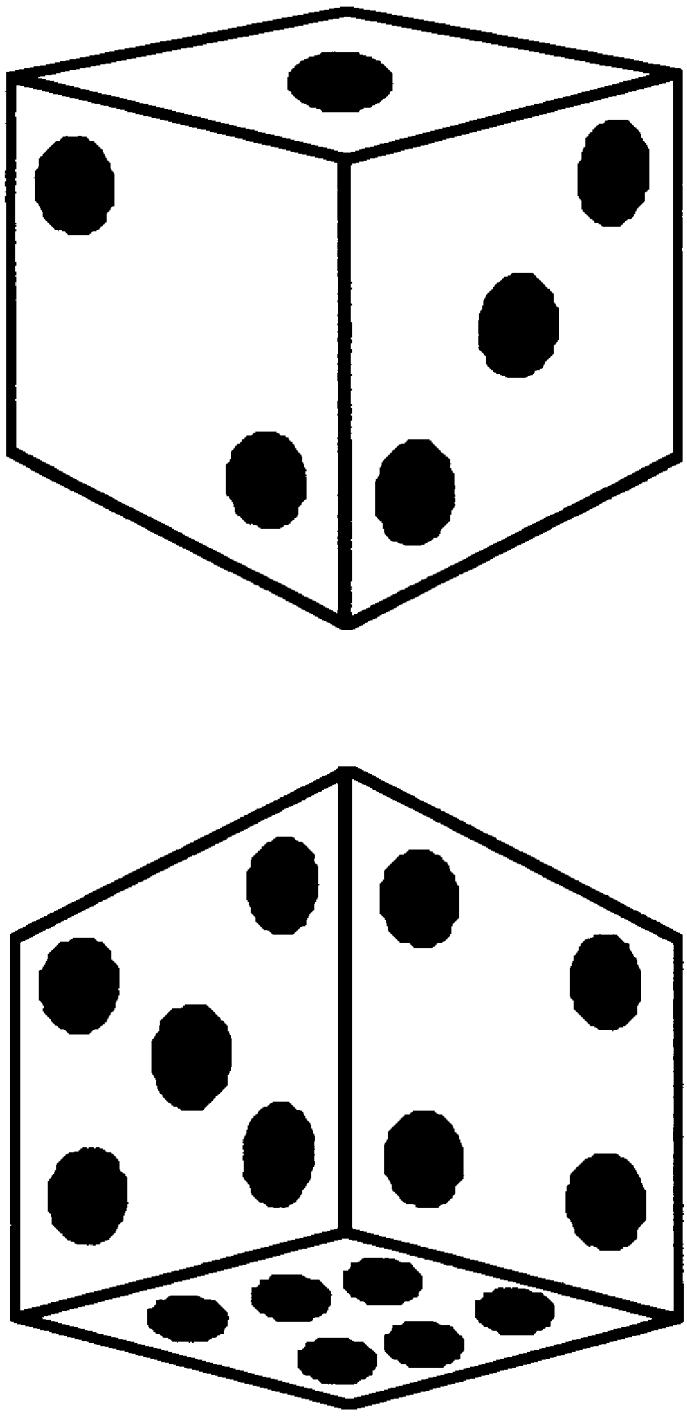
FIG. 5 is a view of a six-sided dotted casino die.

The Dragon-Name Game is a unique letter, word, and number dice game played with three dice, of which the first uses a standard six-sided casino die with dots placed on each face surface ranging from one to six. The second is a special multicolored six-sided die of any size, having the letters, D.R.A.G.O.N. individually placed on said die, such that one letter is inscribed per each face surface. Also, each said letter is associated with a specific color, such that the letter "D" is located on the "blue" surface; the letter "R" is associated with the "red" colored surface; the letter "A" is associated with the "yellow" colored surface; the letter "G" is located on the "green" colored surface; the "O" is located on the "orange" colored surface; and the "N" is associated with the "purple" colored surface, see FIG. 2. The third die, which can be of any size has six blank, partitioned sides, such that the letters of an alternative reference word (e.g. A.L.E.X-.A.N.D.E.R.) can be inscribed on its sides, see FIG. 3, and then substituted for the D.R.A.G.O.N. die when playing the game with more skilled players. The score card of the invention, see FIG. 1, has four play columns 1, II, III, & IV, (13). In each play column there are boxes (14) that are to the right and correspond to each D.R.A.G.O.N. letter in said reference word. These are filled-up with numerical points obtained from the casino die during the play of the game as described below. The highlighted lines (11) subdivide the letter boxes (15) and the point value boxes (14), which increase the capability of said score card to accommodate larger than six-lettered reference words (e.g. A.L.E.X-.A.N.D.E.R.), and used in conjunction with the blank-sided die. The Dragon-Name Game is designed particularly for children of grammar school age, whereby the object of said game is to obtain the greatest amount of numerical points in each play column before any player fills all the play column's boxes (14) with points obtained from the concurrent rolls of the casino die, which ends that round of play for everyone. The player with the highest cumulative score after four rounds of play, wins. The two basic ways to play the Dragon-Name Game are listed below, however, the invention is not limited to said rules of play.

Rules of Play for Method One:

Each player on his/her turn rolls both the D.R.A.G.O.N. die and the dotted casino die together. To start, each player must first roll the "D" on the D.R.A.G.O.N. die. If successful, the corresponding numerical point value on the standard casino dotted die (e.g. 5) is recorded in "Play Column I" in the box next to the letter "D" (14*a*) on the score card, see FIG. 1. If the player is not successful and the "D" is not rolled, the dice are then passed to the next player, who likewise attempts to roll the letter "D", and so on for all players. After rolling the "D", the player now tries to roll the next consecutive letter in D.R.A.G.O.N., which is the letter "R". When successful, the corresponding numerical value from the casino die (e.g. 1) is recorded in "Play Column I" in the box next to the letter "R" (14*b*), and so on. This procedure continues for all players for all remaining consecutive letters until one player fills all six of the point value (14) boxes relating to the D.R.A.G.O.N. letters in "Play Column I" with numerical points from the casino die, which ends the first round of play for everyone. This player has successfully catenated the letters that spell the reference word DRAGON. All players now add up their points in "Play Column I", and record their results in "Play Column Total's" box (10*a*), (e.g. 5+1+3+3+6+2=20). Only one player will have said play column completed with numbers, even though, other players may have higher scores. The game continues with the next round of play in "Play Column II", and so on. When all four rounds of play are completed, the "Play Column Totals" are summed (10*a*+10*b*+10*c*+10*d*) for a "Final Score" (e.g. 20+11+19+17=67), and recorded in box (12). The player with the highest "Final Score", wins. [Note: A "Roll Again" rule can be incorporated when the player rolls the desired letter and associative color on a turn. The numerical points obtained from any duplicate letter roll are ignored.]

Rules of Play for Method Two:

Each player on his/her turn rolls both the D.R.A.G.O.N. die and the dotted, casino die concurrently. In this game variation, there is no ordered sequence of said letters on the D.R.A.G.O.N. die to be followed. Therefore, any letter that appears on a player's roll is valid, wherein, the corresponding numerical points from the dotted casino die are recorded in the point value box (14) to the right of said letter in the play column I. In the event that the same letter arises on subsequent rolls of the letter die, the respective casino die's numerical points are added to the current sum in that point box, wherein the numerical points in each value box becomes cumulative. After each roll, the dice are passed to the next player, such that there is only one roll of the dice per player per turn. This procedure continues until one player fills all of the six (14) point value boxes in play column I with numerical points, which ends the first round of play for everyone. This player has rolled each letter D.R.A.G.O.N. at least once, and therefore, has successfully spelled the reference word, DRAGON. The points in play column I are added up and recorded in play column I total's box, wherein, the second round of play begins in play column II. When all four rounds of play are completed, the play column totals (10*a*+10*b*+10*c*+10*d*+) are summed for each player's final score (12). The player with the highest "Final Score", wins.

The Dragon-Name Game, of the invention, is not limited to a six-sided die, to said reference word D.R.A.G.O.N., to four columns of play, and to said colors. Larger reference words with more letters can use a die having more sides and associated colors, while smaller words can use a die with correspondingly less sides and colors. However, said six-sided die can be partitioned into multiple sections to accommodate more letters for larger reference words and, if desired, more colors, see FIG. 3. These letters of said reference word are inscribed, with an erasable black marker, on the blank surfaces of said blank-sided die, see FIG. 3, which is substituted for the D.R.A.G.O.N. die when playing the game. The score card's point value boxes (14) and write-in letter boxes (15) are subdivided into multiple sections to accommodate those letters of the alternate reference word that are inscribed on the partitioned blank-sided die, see FIG. 1. The same "Rules of Play" apply for the alternate reference word. Since any reference word may be selected, the letters of a player's name offers the best and most familiar choice for learning how to spell a word. The composition of said write-on blank surfaced die should be conducive for erasable markers, wherein said black and colored erasable markers may be included as components in said game.

The Dragon-Name Game is an educational device for developing and improving letter, word, and number recognition using the processes of letter catenation and numerical addition. The Dragon-Name Game can also be played on a more fundamental level using just the associative letter colors on the D.R.A.G.O.N. die instead of the said letters.

What I claim as my invention is:

1. A Dragon Name-Game apparatus comprising:

A six-sided die having the letters D.R.A.G.O.N. placed one said letter per side, wherein each die side is also associated with a color such that the "D" face is colored blue; the "R" face is colored red; the "A" face is colored yellow; the "G" face is colored green; the "O" face is colored orange; and the "N" face is colored purple;

A six-sided die with six blank-face surfaces having a straight line running diagonally from one corner of each face to an opposite corner thus dividing said six blank face surfaces in half;

Erasable colored markers, wherein each said face and half-face surfaces can be drawn upon by said erasable colored markers to inscribe letters and colors of any choice on said blank surfaces;

A standard six-sided dotted casino die; and

A game score card comprised of a column having six boxes with the letters D.R.A.G.O.N. placed vertically, such that one letter is placed per box; another column having six boxes and the colors of blue, red, yellow, green, orange and purple, such that one color is placed per box; a further column having six blank boxes for inscribing letters and colors; and finally four play columns I, II, III, & IV, with six boxes each used for recording numerical values obtained from said standard six-sided dotted casino die used during the play of the game;

Said score card further having six horizontal rows, wherein a first row includes the blue color box, a blank box, the "D" lettered box, and one box from each of the play columns I, II, III, & IV, a second row contains the red color box, a blank box, the "R" lettered box, and one box from each of the play columns I, II, III, & IV, a third row contains the yellow color box, a blank box, the "A" lettered box, and one box from each of the play columns I, II, III, & IV, a fourth row contains the green color box, a blank box, the "G" lettered box, and one box from each of the play columns I, II, III, & IV, a fifth row contains the orange color box, a blank box, the "O" lettered box, and one box from each of the play columns I, II, III, & IV, a sixth row contains the purple color box, a blank box, the "N" lettered box, and one box from each of the play columns I, II, III, & IV, and an additional row included at the bottom of the columns for tabulating the play column totals of each said play columns I, II, III, & IV, and having an additional box at its end for recording the final score, wherein said game is played with a six-sided standard dotted casino die which provides the numerical values for scoring in play columns I, II, III, and IV.

2. The game apparatus, as described in claim 1, wherein the six-sided die with six blank-face surfaces is composed of a substance that allows for erasable markers to inscribe any letter and/or color onto said surfaces.

3. The game apparatus, as described in claim 2, wherein said straight line running diagonally is an etched line, thereby creating a total of twelve half-face blank surfaces, which are used when additional space is required for names and words with more than six letters.

4. The game apparatus, as described in claim 1, wherein the six blank boxes from said another column are horizontally divided in half, thereby providing twelve blank half-boxes, such that a letter and/or color placed in said half box will correspond to its respective letter and/or color inscribed on the half-face surface of the blank die.

5. The game apparatus, as described in claim 1, wherein the boxes in the play columns I, II, III, and IV are divided horizontally in half, thereby providing additional respective scoring boxes for the inscribed letters and/or colors placed on the blank half-faced surfaces of the blank-faced die, when more than six surfaces are used.

* * * * *